US006167832B1

(12) United States Patent
Vooris

(10) Patent No.: US 6,167,832 B1
(45) Date of Patent: Jan. 2, 2001

(54) CHIME TUBE HANGER CORD CONNECTOR

(76) Inventor: Franklyn P. Vooris, 3097 State Rte. 28, Shokan, NY (US) 12481

( * ) Notice: Under 35 U.S.C. 154(b), the term of this patent shall be extended for 0 days.

(21) Appl. No.: 09/246,887

(22) Filed: Feb. 8, 1999

(51) Int. Cl.[7] ..... G10D 13/00
(52) U.S. Cl. ..... 116/169; 116/141; 84/403
(58) Field of Search ..... 116/169, 141, 116/148, 150; 84/402, 403, 404; 403/365, 368

(56) References Cited

U.S. PATENT DOCUMENTS

| | | | | |
|---|---|---|---|---|
| 485,542 | | 11/1892 | Harrington . | |
| 527,488 | * | 10/1894 | Gerry | 116/169 |
| 1,813,171 | * | 7/1931 | Klein | 116/169 |
| 2,249,381 | * | 7/1941 | Gustafson | 403/368 |
| 2,278,126 | | 3/1942 | McMullen . | |
| 2,820,431 | | 1/1958 | Lescher . | |
| 2,859,469 | * | 11/1958 | Stockdale | 403/368 |
| 4,306,620 | * | 12/1981 | Fromius | 403/368 |
| 5,660,376 | * | 8/1997 | West | 256/22 |

FOREIGN PATENT DOCUMENTS

| | | | | |
|---|---|---|---|---|
| 524194 | * | 5/1921 | (FR) | 403/365 |

* cited by examiner

*Primary Examiner*—Andrew H. Hirshfeld
(74) *Attorney, Agent, or Firm*—Charles J. Brown, Esq.

(57) ABSTRACT

In a chime tube suupported by a coaxial hanger cord, a resilient clip element connecting the cord and the interior of the chime tube having two or more legs which have a straight line length longer than the inside radius of the chime tube before insertion and which bend to grip the inside of the chime tube upon insertion and hold the clip element at the desired position.

1 Claim, 1 Drawing Sheet

CHIME TUBE HANGER CORD CONNECTOR

BACKGROUND OF THE INVENTION

Chime tubes held at their nodal points are typically struck on their exterior to emit sound. The usual manner of supporting such tubes in vertical position is to provide a hanger cord secured at its upper end to a fixed member and extending vertically down to some form of connection at its lower end with the tube. They may also be held in a horizontal position with the cord stretched horizontally between fixed points.

The connection between the hanger cord and the chime tube has taken many forms in the prior art. Cylindrical plug elements have been forced into the ends of cylindrical chime tubes for connection to hanger cords. U.S. Pat. No. 1,813,171, for example, discloses one form of such a plug element force-fitted into the upper end of a chime tube. Other means for connecting hanger cords to chime tubes include holes or indentations formed in the chime tube wall, one form of which is disclosed in U.S. Pat. No. 2,820,431. Variations include the drilling of holes through opposite sides of the chime tube at its nodal point and insertion of the hanger cord through the holes so that two runs of the cord extend upwardly on the outside of the chime tube to the point of suspension. It is also known to insert an expansion spring of small diameter through the opposed holes in the chime tube with the hanger cord secured to the mid-point of the spring.

Also of interest in the prior art are chime tube configurations which include stiffening elements having equally circumferentially spaced legs inserted within the chime tube at suitable levels for stiffening or solidifying the tubes. One form of this design is disclosed in U.S. Pat. No. 485,542. They function to control the pitch of emitted sound and not for attachment of hanger cords.

It is the general purpose of the present invention to provide an improved form of connection between the interior of a chime tube and a central hanger cord by which the chime tube is supported. This is to be done without in any way altering the structure of the chime tube by drilling of holes or forming of indentations or otherwise. In addition, the connector of the invention is to be separately insertable so that it can be easily placed at the nodal point of the chime tube if desired.

SUMMARY OF THE INVENTION

In accordance with the invention an elongated chime tube is supported by a coaxial hanger cord. The connector between the cord and the chime tube includes a resilient clip element slidably inserted within the chime tube and having at least two legs extending equidistantly from a central point of connection with the cord. The legs of the clip element have a straight line length greater than the inside radius of the chime tube before insertion and bend to grip the inside of the chime tube after insertion.

In a preferred form of the invention the legs of the clip element are of outwardly curved configuration even prior to insertion and are bent still more when inserted in the chime tube. The clip element may comprise three legs equally spaced circumferentially and may include a central hole through which the hanger cord is secured. Both the chime tube and the clip element may be of metal. The chime tube in which the clip element is located may be vertical or non-vertical including horizontal.

DESCRIPTION OF PREFERRED EMBODIMENT

Figure 1:
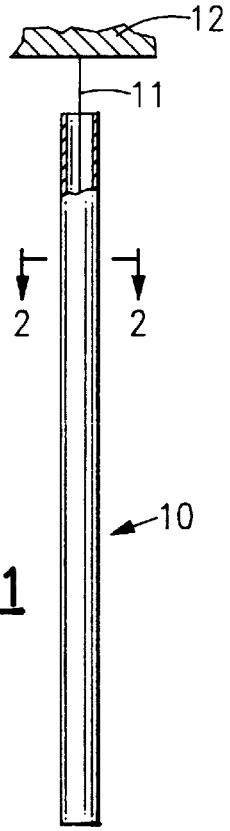
FIG. 1 is an overall side elevation partly in section of a vertical chime tube and hanger cord in which the connector of the invention is to be included.

Referring first to FIG. 1, a conventional elongated metal chime tube 10 is shown which is open at its upper and lower ends. In most assemblies the chime tube is cylindrical as shown here though cross sections other than circular may be employed. Some form of clapper, not shown, is used for striking the chime tube 10 to cause it to emit sound. The chime tube 10 is suspended vertically by means of a coaxial hanger cord 11 connected at its lower end to the chime tube at the nodal point thereof in a manner described below. The upper end of the hanger cord 11 is suitably secured to some fixed frame 12.

Figure 3:
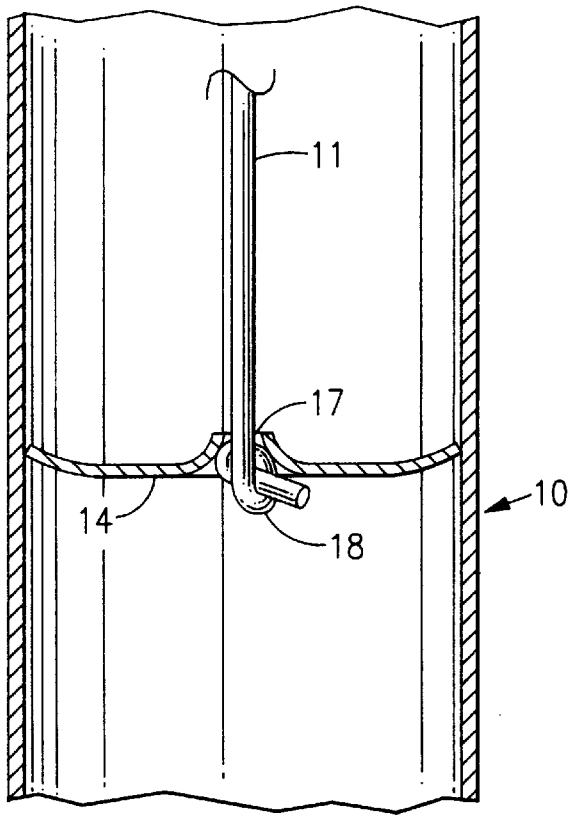
FIG. 3 is a vertical section taken along the line 3—3 of FIG. 2.
Figure 2:
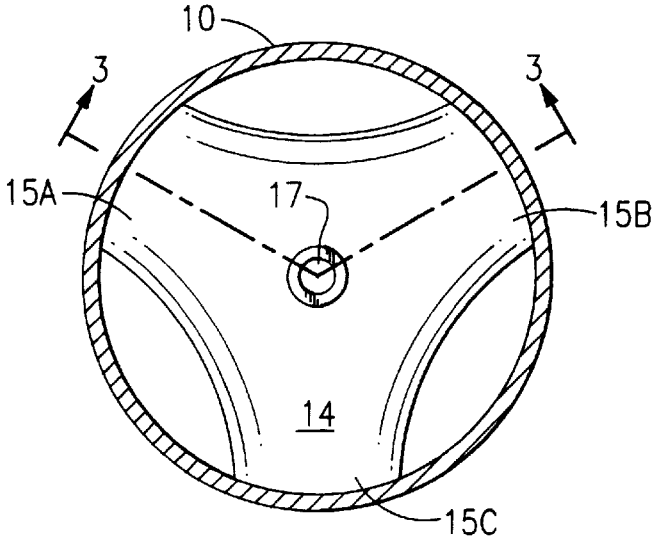
FIG. 2 is an enlarged horizontal section taken along the line 2—2 of FIG. 1 showing the connector of the invention between the hanger cord and the chime tube.
Figure 4:
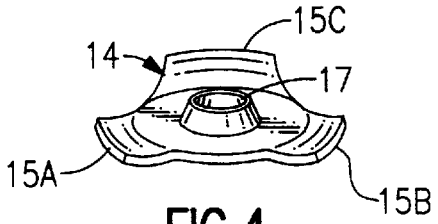
FIG. 4 is an enlarged perspective view of the connector shown in FIGS. 2 and 3.

As shown particularly in FIGS. 2 to 4, the connector between the chime tube 10 and the lower end of the cord 11 comprises a resilient metal clip element 14. Three radial legs 15A, 15B and 15C are included in the clip element 14 extending equidistantly from a central hole 17. The lower end portion of the cord 11 extends downwardly through the hole 17 with an enlarged knot 18 shown in FIG. 2 preventing upward withdrawal.

As shown particularly in FIG. 3, the three legs 15A to C of the clip element 14 are of upwardly curved configuration in a radial direction. Before insertion these legs have a straight line length slightly greater than the inside radius of the chime tube 10.

In the assembly of the device the clip element 14 with the cord 11 in place is pushed downwardly through the open upper end of the chime tube 10 so that the three legs 15A to C bend upwardly to a lesser straight line length to grip the inside of the chime tube 10.

The thickness of the clip element 14 is selected so that the three legs 15A to C bend upwardly into the position shown in FIG. 3 upon manual insertion into the chime tube 10 and in doing so they create a sufficient outward force on the inside of the chime tube 10 so that the clip element 14 holds itself in place at the nodal point of the chime tube 10 even with the weight of the chime tube 10 creating a downward force on the clip element 14.

Again, it is contemplated that the chime tube 10 may be vertical as in the embodiment described above or it may be non-vertical and particularly horizontal. More than one clip element may be located in the chime tube and the clip element or elements may be located within the chime tube at other than nodal points thereof.

The scope of the invention is to be determined by the following claims rather than the foregoing description of the preferred embodiment.

What is claimed is:

1. In combination with an elongated cylindrical chime tube suspended vertically from a knotted lower end portion of a coaxial vertical hanger cord, a connector between the cord and the chime tube comprising a) a unitary resilient clip element slidably inserted within said chime tube and having plurality of equally spaced circumferentially, said legs extending equidistantly and integrally from a central unthreaded hole through which the hanger cord knotted lower end portion extends and is secured, b) the legs of the clip element being of upwardly curved configuration in a radial direction and having a straight line length greater than the inside radius of the chime tube before insertion and bending upwardly to grip the inside of the chime tube after insertion.

* * * * *